US005200115A

United States Patent [19]

Giesen et al.

[11] Patent Number: 5,200,115

[45] Date of Patent: Apr. 6, 1993

[54] PASTE-FORM DETERGENT CONTAINING ALKYL GLYCOSIDE AND α-SULFOFATY ACID DI-SALT AS SURFACTANTS

[75] Inventors: Brigitte Giesen, Duesseldorf-Grafenberg; Alfred Meffert, Monheim; Andreas Syldatk; Ingo Wegener, both of Duesseldorf, all of Fed. Rep. of Germany

[73] Assignee: Henkel Kommanditgesellschaft auf Aktien, Duesseldorf-Holthausen, Fed. Rep. of Germany

[21] Appl. No.: 656,050

[22] PCT Filed: Aug. 7, 1989

[86] PCT No.: PCT/EP89/00933

§ 371 Date: Feb. 15, 1991

§ 102(e) Date: Feb. 15, 1991

[87] PCT Pub. No.: WO90/02163

PCT Pub. Date: Mar. 8, 1990

[30] Foreign Application Priority Data

Aug. 16, 1988 [DE] Fed. Rep. of Germany ..... 3827778

[51] Int. Cl.[5] ..... C11D 1/83

[52] U.S. Cl. ..... 252/557; 252/174.17; 252/549; 252/554; 252/555; 252/558; 252/559; 252/121

[58] Field of Search ..... 252/549, 554, 555, 557, 252/558, 559, 121, 174.17

[56] References Cited

U.S. PATENT DOCUMENTS

| | | | |
|---|---|---|---|
| 4,514,325 | 4/1985 | Russo et al. | 252/557 |
| 4,532,076 | 7/1985 | Schmid et al. | 252/557 |
| 4,663,069 | 5/1987 | Llenado | 252/174.17 |
| 4,678,595 | 7/1987 | Malik et al. | 252/557 |
| 4,772,426 | 9/1988 | Koch et al. | 252/557 |
| 4,839,098 | 6/1989 | Russo et al. | 252/557 |
| 4,861,508 | 8/1989 | Wegener et al. | 252/557 |
| 4,976,885 | 12/1990 | Wisotzki et al. | 252/174.17 |
| 5,025,069 | 6/1991 | Deguchi et al. | 252/174.17 |
| 5,118,440 | 6/1992 | Cutler et al. | 252/174.17 |

FOREIGN PATENT DOCUMENTS 0070075 1/1983 European Pat. Off. .

*Primary Examiner*—A. Lionel Clingman
*Assistant Examiner*—Bradley A. Swope
*Attorney, Agent, or Firm*—Ernest G. Szoke; Wayne C. Jaeschke; Daniel S. Ortiz

[57] ABSTRACT

The aqueous paste contains an alkyl glucoside as nonionic surfactant and an α-sulfofatty acid disalt as anionic surfactant; a thickener, for example carboxymethy cellulose, may also be present for adjusting viscosity. The paste-form detergent is produced by mixing concentrated aqueous pastes of the surfactants and, optionally, the thickener, the pH optionally being adjusted to a substantially neutral value by addition of a regulator. The paste-form detergents are suitable both for the washing of laundry and for the washing of hard surfaces, for example dishes.

12 Claims, No Drawings

PASTE-FORM DETERGENT CONTAINING ALKYL GLYCOSIDE AND α-SULFOFFATY ACID DI-SALT AS SURFACTANTS

This invention relates to a paste-form, water-based detergent which is suitable for the washing both of laundry and of articles having hard surfaces, more especially for manual dishwashing.

A viscous detergent concentrate containing at least one nonionic surfactant and at least two anionic surfactants and an organic solvent is known from EP 0 243 685 A2. This detergent concentrate, which contains ethoxylated alcohols or ethoxylated alkylphenols as nonionic surfactants and alkyl benzenesulfonates, alkyl ether sulfates and alkane sulfonates as anionic surfactants, may be diluted with water. It is suitable above all for manual dishwashing. GB 2,184,452 A describes a paste-form builder-containing detergent for the washing of laundry, dishes and hard surfaces which, in addition to a synthetic anionic surfactant of the fatty alcohol sulfate type, contains typical builders, such as sodium tripolyphosphate for example, and also free alkanolamine.

Glycosides of long-chain aliphatic alcohols, particularly fatty alkyl glucosides, are known from U.S. Pat. No. 3,219,656 (Boettner). These fatty alkyl glycosides are classed as nonionic surfactants. They may be combined with other nonionic and anionic surfactants and, hence, are suitable for use in detergents. A particular advantage of alkyl glycosides is their biodegradability. It is known from U.S. Pat. No. 3,547,828 (Mansfield et al) that the alkyl glucosides prepared by acidic catalysis from fatty alcohol and glucose may be regarded as three-component mixtures of alkyl monoglucoside, alkyl oligoglucosides and residual fatty alcohol.

The alkyl glycosides suitable for use as surfactants may generally be represented by the structural formula $RO(G)_x$, where R is an aliphatic radical containing at least 8 carbon atoms, preferably the residue of a primary alcohol and, more preferably, a fatty alkyl or fatty alkenyl radical containing 8 to 22 and preferably 12 to 18 carbon atoms. The symbol (G) in the formula stands for a glycose unit, glucose being preferred by virtue of its technical availability on the one hand and its high reactivity on the other hand. Finally, the index x is a number of 1 to 10 which represents the so-called degree of oligomerization, i.e. the distribution of monoglycosides and oligoglycosides. Whereas, in a given compound, x must always be a whole number, above all the number 1, 2, 3 or 4, the value x for a special alkyl glycoside process product, as an analytically determined theoretical value, is generally a broken number. Where the alkyl glycosides are represented by the formula $RO(G)_x$, the fatty alcohol component is disregarded. In principle, this fatty alcohol component may largely be controlled by careful distillation of the alkyl glycoside, i.e. the excess of fatty alcohol emanating from the reaction may be removed from the product to residual values of less than 1% of the total fatty alcohol component.

A foaming surfactant composition containing a special surface-active alkyl glycoside having a degree of oligomerization x of 1.5 to 10 and an alkyl monoglycoside content of 20 to 70% by weight, together with an anionic cosurfactant selected from the group consisting of surface-active sulfates, sulfonates, carboxylates and mixtures thereof, is described in EP 0 070 074 A2. The anionic cosurfactants mentioned include, in particular, alkyl benzenesulfonate, soap, zwitter-ionic surfactants, amphoteric surfactants, alkane sulfonates, α-olefin sulfonates, alkyl sulfates, alkyl polyglycol ether sulfates and paraffin sulfates and mixtures thereof. The described surfactant compositions are suitable for the production of products which foam vigorously in use, such as for example manual dishwashing detergents and shampoos.

The surface-active properties of the salts of α-sulfonated fatty acids, particularly the sodium salt, are known from "The Journal of the American Oil Chemists' Society", (1954), Vol. 31, pages 13 et seq and from Vol. 34 (1957), pages 100 et seq. Laundry detergents containing alkali salts of α-sulfonated, saturated $C_{14-20}$ fatty acids in addition to typical nonionic and/or anionic surfactants are known from German patent applications DE 21 44 592 B2 and DE 21 61 726 B2. These sodium disalts are regarded as builders and are combined with the typical surfactants mentioned either on their own or together with other typical builders.

German patent application P 38 03 724.6 describes a process for washing laundry in standard automatic washing machines in which the at least predominant part of the surfactants, optionally together with other typical detergent constituents, are directly added to the dry or dampened laundry in the washing machine in the form of a paste showing substantial dimensional stability at room temperature. In addition to a number of typical detergent constituents of the surfactant and builder type, alkyl glycosides and disalts of α-sulfofatty acid are also mentioned.

The invention relates to a paste-form detergent and cleaning preparation containing nonionic and anionic surfactants which is characterized in that it essentially contains a surfactant combination of an alkyl glycoside as nonionic surfactant and an α-sulfofatty acid disalt as water-based anionic surfactant.

In the context of the invention, the expression "paste-form" is understood to encompass the range from viscous and free-flowing to substantially dimensionally stable and pasty. Accordingly, this includes viscous liquids, flowable gels, flowable pastes and pasty masses. The viscosity (as measured in accordance with Höppler at 20° C. or in accordance with Brookfield Helipath at 20° C./4 revolutions per minute) is thus in the range from about 1,000 to 200,000, preferably in the range from 2,000 to 100,000 and more preferably in the range from 5,000 to 90,000 mPa.s The flowable to viscous pastes are further characterized by a minimum dissolving rate to be determined under certain conditions as follows:

To determine the dissolving rate, 1 g of the paste-form product is introduced in the form of a coherent mass into a tall, 250 ml glass beaker approximately 5.5 cm in diameter, followed by the addition of 100 ml water at a temperature of 20±2° C. For stirring, a 3 cm long magnetic stirring rod is introduced into the glass beaker and the contents of the glass beaker are subsequently stirred at 500 revolutions per minute at the temperature indicated. The time which the paste takes to dissolve completely or to form a fine dispersion is measured. The pastes according to the invention dissolve completely in at most 10 minutes, i.e. a homogeneous, cloudy, slightly pearlescent solution or suspension is formed. This complete disappearance of the paste-form consistency and the formation of the fine dispersion preferably take place after only 2 to 5 minutes.

A particular advantage of the paste-form detergent according to the invention is that the highly viscous mixture of substances even breaks up in water at room temperature under relatively mild stirring conditions, rapidly forming the desired wash liquor.

The alkyl glycosides suitable for the detergent according to the invention and their production are described, for example, in U.S. Pat. No. 3,547,828 and 3,839,318 and in European patent applications 0 092 255 Al and 0 165 721 Al. By virtue of their light color, their color stability and their special composition, the alkyl glycosides described in German patent application P 37 23 826.4, which have an alkyl monoglycoside content of more than 70% by weight (based on the total quantity of alkyl monoglycosides and alkyl oligoglycosides) and an average degree of oligomerization x of less than 1.5 in the alkyl glycoside formula shown above, are particularly suitable. Typical representatives of alkyl glycosides having the properties of a nonionic surfactant are those of which the aliphatic radical is a typical fatty alkyl radical, i.e. for example octyl, decyl, dodecyl, tetradecyl, hexadecyl, octadecyl. Particularly suitable alkyl glycosides contain a coconut oil fatty alkyl radical, i.e. mixtures essentially containing dodecyl and tetradecyl.

The sugar component of the alkyl glycoside may emanate in principle from typical aldoses or ketoses, such as for example glucose, fructose, mannose, galactose, talose, gulose, allose, altrose, idose, arabinose, xylose, lyxose and ribose. By virtue of the availability of glucose in large quantities and by virtue of their high reactivity, alkyl glucosides are particularly preferred. It may be regarded as a particular advantage of alkyl glycosides in the form of fatty alkyl glucosides that they are produced entirely from renewable raw materials, mainly fats on the one hand and sugars or starches on the other hand. Although the pastes according to the invention may also contain alkyl glycosides of which the alkyl radical is derived from synthetic primary alcohols, particularly the so-called oxo alcohols, i.e. primary alkanols containing a certain percentage of branched isomers, alkyl glycosides such as these are less preferred in the present case because one of the objects of the invention is for both essential components of the detergent according to the invention to be produced from natural renewable raw materials.

The α-sulfofatty acid disalts (hereinafter referred to in short as disalts) suitable for use in accordance with the invention may be prepared in known manner by sulfonation of fatty acids, followed by bleaching and conversion into the salts. Particularly light-colored disalts of neutral odor are obtained by sulfonation of the corresponding, purified fatty acid methyl ester, followed by bleaching and saponification of the ester group and conversion into the disalt. Preferred cations for salt formation are cations of the alkali metals, particularly sodium. However, magnesium disalts may also be used in accordance with the invention. Disalts containing the ammonium cation and cations derived from mono-, di- and triethanolamine are also suitable.

For the production of the paste-form detergent according to the invention, both the alkyl glycosides and also the disalts are best used in the form of aqueous pastes as starting materials, the concentration of the alkyl glycoside pastes being in the range from 50 to 70% by weight and the concentration of the disalt pastes in the range from 20 to 35% by weight.

A typical example of an alkyl glycoside paste is the coconut oil alkyl glucoside with a degree of oligomerization of 1.3 prepared from coconut oil fatty alcohols with a $C_{12}/C_{14}$ ratio of approximately 3:1 in a concentration of approximately 60% by weight. A typical disalt paste contains a sulfofatty acid disalt based on a $C_{16}/C_{18}$ fatty acid prepared from tallow fatty acid in a concentration of approximately 28% by weight.

Paste-form detergents according to the invention contain alkyl glycoside and disalt as essential constituents of the surfactant combination. "Essential" is understood to mean that, in a first and preferred embodiment, the detergent according to the invention consists solely of the alkyl glycoside and the disalt together with water. In this case, the quantitative ratio of alkyl glycoside to disalt is from 10:1 to 1:3 and preferably from 8:1 to 1:1. The total quantity of alkyl glycoside and disalt in the detergent according to the invention is preferably from 10 to 50% by weight and more preferably from 15 to 35% by weight. These concentrations arise as an optimum out of the blendability of the paste-form detergent from the starting materials on the one hand and, in particular, out of the ready dissolvability, even in cold water, of the detergent according to the invention, an important property thereof. In another preferred embodiment, the detergent according to the invention contains as a further constituent a soap which preferably corresponds to at most the quantity of the disalt and which is also preferably based on the same fatty acid. It has been found that soap components such as these do not impair the cleaning power of the detergent, so that the soap component may be present as an inexpensive diluent. With a soap as an additional constituent of the detergent according to the invention, the technical disalts which, generally, still contain soaps from their production as a result of the incomplete sulfonation of the starting materials may be directly used as technical products.

Unless the desired paste consistency is established solely by the quantity of the two principal constituents and by their quantitative ratio, the detergent according to the invention may also contain typical thickeners. Suitable thickeners are, primarily, natural polymer compounds and derivatives thereof, more especially derivatives of cellulose and starch, such as for example carboxymethyl cellulose or methyl cellulose or carboxymethyl starch, also alginates, xanthane and guar gums. Synthetic thickeners of the polyacrylate and/or polymethacrylate type, which may even be partly crosslinked, are also suitable.

In addition, the detergents according to the invention may contain additives typical of paste-form detergents, including above all perfumes and dyes, water-soluble or water-insoluble builders, enzymes and pH regulators. However, a particular advantage of the detergents according to the invention is that, by virtue of their very faint odor and their attractive appearance, there is no need to use dyes or perfumes. Depending on the total quantity of and quantitative ratio between the two principal components, the detergent itself has a white pearlescence without any need for the addition of a special pearlescer, as is generally the case. Where the detergent according to the invention contains additional builders, ecologically safe substances, such as for example citric acid and salts thereof and a zeolite A, are preferably used.

The detergent according to the invention may be used as a universal detergent both for the manual washing of objects having hard surfaces, for example dishes, and for the washing of laundry by hand or in washing machines at relatively low temperatures from room temperature to approximately 60° C., but mainly in the 30°–40° C. wash. The paste-form detergent is distinguished by high stability in storage and is easy to dispense. To this end, the detergent is squeezed out either from flexible plastic bottles or from tubular bags in the form of a paste-like strand or highly viscous liquid or is removed from containers having relatively large openings with a spatula or a spoon, in which case the quantity to be removed, for example, with a teaspoon or dessert spoon may also readily be used as a dispensing measure. Suitable containers with relatively large openings are, for example, round or rectangular cans or boxes of sheet metal, plastic or coated cardboard with simple closure covers.

The detergents according to the invention may be produced in known manner by mixing the alkyl glycoside and the disalt, preferably in the form of concentrated aqueous pastes, with one another in the desired quantitative ratio and adjusting the desired concentration and viscosity, optionally by addition of water and/or a thickener, so that the concentration is in the range from 10 to 50% by weight and preferably in the range from 15 to 35% by weight while the viscosity is in the range from about 1,000 to 200,000, preferably in the range from 2,000 to 100,000 and more preferably in the range from 5,000 to 90,000, the pH value of the mixtures (based on the measurement of a 10% solution) optionally being adjusted to a substantially neutral value by addition of a regulator. Suitable pH regulators are system-compatible and environment-friendly acids, for example citric acid, tartaric acid, glycolic acid, malic acid, technical mixtures of succinic acid, glutaric acid and adipic acid, or inorganic acids, for example sulfuric acid.

EXAMPLES

EXAMPLE 1

A 58.7% aqueous paste of a coconut oil fatty alkyl glucoside having a $C_{12}/C_{14}$ distribution of approximately 3:1 and a degree of oligomerization of 1.3 was used as the alkyl glycoside while the sodium salt of $\alpha$-sulfo-$C_{16}/C_{18}$-tallow fatty acid in the form of a 28% aqueous paste was used as the disalt. The paste-form detergent was prepared by mixing 13.5 g of the alkyl glycoside and 4.5 g of the disalt, based in each case on the anhydrous substance, and adding 1.0% by weight carboxymethyl cellulose in powder form. The paste was adjusted to pH 7.2 by addition of citric acid. The viscosity of the paste thus prepared (Höppler, 20° C.) was 27,960.

Dishwashing Power

To determine dishwashing power, the paste-form detergent was dissolved in water at 45° C. in a concentration of 1 g/l. This dosage substantially corresponds to 1 teaspoonful per 5 l water. Two wash liquors are prepared using water of different hardness, namely 3° Gh and 16° Gh. Beef tallow (approximately 1.7 g per dish) was used as standard soil (see H.-J. Lehmann, Fette, Seifen, Anstrichmittel, 74, (1972), pages 163 to 165).

Maximum number of dishes in water of 3° Gh: 20
Maximum number of dishes in water of 16° Gh: 17

Determination of Washing Power

Washing power was determined in a Launderometer at 40° C., dosage 3 g paste per liter, in water of 16° Gh, test cloths of cotton, processed cotton, blends of polyester/processed cotton and polyester using a standard soil of synthetic sebum and synthetic street dust and with a liquor ratio of 1:30. The remission values of the washed fabric samples were determined and a mean value calculated from the results. A value of 44.4 was determined; initial value 26. A similar washing test carried out at room temperature produced a remission value of 40.9.

EXAMPLE 2

The alkyl glycoside of Example 1 was used; instead of the sodium salt of Example 1, the corresponding magnesium salt was used as the disalt. A paste containing 18% surfactant was prepared in otherwise the same way as in Example 1, but with a quantitative ratio of alkyl glycoside to disalt of 3:2. The water used had a hardness of 16° Gh. Determination of the dishwashing power produced a value of 17 dishes. The washing power of this paste was determined as in Example 1 in a Launderometer using test cloths of polyester/processed cotton and a standard soil of dust/sebum. A remission value of 42 was measured. Additions of neutral salts, such as sodium sulfate, and builders, such as sodium triphosphate, had an enhancing effect.

EXAMPLE 3

In this Example, the properties of a detergent according to the invention are compared with those of a conventional paste-form detergent.

A paste having the following composition was prepared in accordance with GB-PS 2,184,452, Example C: 23% by weight coconut oil alcohol sulfate, 1.0% by weight triethanolamine, 24.5% by weight sodium triphosphate, 6.0% by weight soda, 1.1% by weight carboxymethyl cellulose, 2.5% by weight sodium sulfate, remainder water.

Based on its surfactant content of coconut oil alcohol sulfate, this paste contained 23% by weight surface-active substances. The paste was white and did not flow and had a Brookfield viscosity, as determined in a Helipath at room temperature (RVF), of 350,000 mPa.s.

The detergent according to the invention had the following composition:

10.0 % by weight alkyl glycoside as in Example 1,
8.0 % by weight sodium disalt as in Example 1,
2.0 % by weight carboxymethyl cellulose,
remainder water.

In appearance, the detergent according to the invention was a white paste which still just flowed; viscosity 87,500 mPa.s.

Whereas the detergent according to the invention dispersed uniformly in 2 minutes and 10 seconds to form a cloudy, slightly pearlescent wash liquor in the test described above, the known detergent took 12 minutes and 30 seconds to achieve the same result.

Dishwashing power was measured with 1 g/l of both products in water at 45° C. Detergent according to the invention: 16 dishes at 3° Gh, 15 dishes at 16° Gh. Known detergent: 12 dishes at 3° Gh, 3 dishes at 16° Gh.

Washing power was determined in a Launderometer at 40° C., dosage 3 g/l, water hardness 16° Gh, liquor ratio 1:30, using the test soils described in Example 1.

The same mean remission value of 42 was obtained for both pastes.

In terms of overall peformance, the known formulation is distinctly poorer than the formulation according to the invention on account of its lower dishwashing power and poorer dissolving behavior and on account of its content of unwanted sodium triphosphate.

We claim:

1. A paste-form laundry and cleaning detergent, containing nonionic and anionic surfactants and water, having a viscosity Hoeppler at 20° C. or according to Brookfield Helipath at 20° C. and four rpm) in the range from about 1000 to 200,000 mPa.sec, consisting essentially of an alkyl glycoside containing 8 to 22 carbon atoms in the alkyl chain as the nonionic surfactant and an α-sulfo-fatty acid di-salt as the anionic surfactant, with a weight ratio of the alkyl glycoside to the α-sulfo-fatty acid di-salt of 10:1 to 1:3, and having a dissolving time not greater than 10 min per 1 g of the detergent in 100 ml water the dissolving time determined by adding 1 gram of the paste form product, in the form of a single portion, to a 250 milliliter glass beaker about 5.5 centimeter in diameter, adding 100 milliliters of water at 20±2° C. to the beaker, stirring the contents of the beaker with a 3 centimeter long magnetic stirring rod at 500 RPM and measuring the time which the paste takes to dissolve, the time which 1 gram of paste-form product takes to dissolve under the test conditions is the dissolving time.

2. A paste-form detergent of claim 1, wherein the weight ratio of alkyl glycoside to α-sulfo-fatty acid di-salt is from 8:1 to 1:1.

3. A paste-form detergent of claim 1 wherein the alkyl glycoside and α-sulfo-fatty acid di-salt comprise 10–50 wt % of the detergent composition.

4. A paste-form detergent of claim 1 further comprising a soap present up to an amount equal to the weight of the α-sulfo-fatty acid di-salt present in the paste-form detergent.

5. A paste-form detergent of claim 1 further comprising a thickener present in an amount sufficient to provide a viscous, free-flowing to pasty, solid consistency.

6. A paste-form detergent of claim 1 having an approximately neutral pH.

7. A paste-form detergent of claim 1 further comprising at least one usual additive for laundry and detergent pastes selected from the group consisting of coloring materials, perfumes, enzymes, electrolyte salts, builders, and pH value regulators.

8. A process for producing the paste-form detergent of claim 3 which comprises: mixing an aqueous composition containing from 50 to 70% by weight alkyl glycoside and an aqueous composition containing from 20 to 35% by weight of α-sulfo-fatty acid di-salt, and if required to adjust the viscosity or concentration at least one of water or thickening agent, to a concentration of 10 to 50% wt % and a viscosity in the range of about 1000 to 200,000 mPas, and if desired, the pH value is adjusted to an approximately neutral value by adding a regulator.

9. A process of claim 8 wherein water is added to the mixture.

10. A process of claim 8 wherein a thickening agent is added to the mixture.

11. A process of claim 8 wherein the pH is adjusted to an approximately neutral value.

12. A paste-form detergent of claim 3 containing from 15 wt % to 35 wt % of a mixture of alkyl glycoside and α-sulfo-fatty acid di-salt.

* * * * *